US011226163B2

(12) United States Patent
Norén

(10) Patent No.: US 11,226,163 B2
(45) Date of Patent: Jan. 18, 2022

(54) HEAT TRANSFER PLATE AND HEAT EXCHANGER COMPRISING A PLURALITY OF SUCH HEAT TRANSFER PLATES

(71) Applicant: ALFA LAVAL CORPORATE AB, Lund (SE)

(72) Inventor: Mattias Norén, Malmö (SE)

(73) Assignee: ALFA LAVAL CORPORATE AB, Lund (SE)

( * ) Notice: Subject to any disclaimer, the term of this patent is extended or adjusted under 35 U.S.C. 154(b) by 0 days.

(21) Appl. No.: 16/500,286

(22) PCT Filed: Dec. 14, 2017

(86) PCT No.: PCT/EP2017/082766
§ 371 (c)(1),
(2) Date: Oct. 2, 2019

(87) PCT Pub. No.: WO2018/197031
PCT Pub. Date: Nov. 1, 2018

(65) Prior Publication Data

US 2020/0386493 A1 Dec. 10, 2020

(30) Foreign Application Priority Data

Apr. 26, 2017 (EP) ..... 17168160

(51) Int. Cl.
*F28F 3/02* (2006.01)
*F28D 9/00* (2006.01)
*F28F 3/08* (2006.01)

(52) U.S. Cl.
CPC ..... *F28F 3/025* (2013.01); *F28D 9/005* (2013.01); *F28F 3/083* (2013.01)

(58) Field of Classification Search
CPC .. F28F 3/086; F28F 3/025; F28F 3/083; F28F 3/044; F28F 3/046; F28D 9/0043; F28D 9/005
See application file for complete search history.

(56) References Cited

U.S. PATENT DOCUMENTS 4,307,779 A * 12/1981 Johansson ..... F28F 3/046 165/166
4,434,643 A * 3/1984 Almqvist ..... B21D 53/04 29/890.039

(Continued)

FOREIGN PATENT DOCUMENTS

CN 1102287 A 5/1995
CN 2809567 Y 8/2006

(Continued)

OTHER PUBLICATIONS

International Search Report (PCT/ISA/210) dated Mar. 27, 2018, by the European Patent Office as the International Searching Authority for International Application No. PCT/EP2017/082766.

(Continued)

*Primary Examiner* — Joel M Attey
*Assistant Examiner* — For K Ling
(74) *Attorney, Agent, or Firm* — Buchanan Ingersoll & Rooney PC

(57) ABSTRACT

A heat transfer plate includes a heat transfer area comprising alternately arranged ridges and valleys in relation to a central extension plane of the plate. The ridges form arrows comprising first arrows, which first arrows each comprises two legs arranged on opposite sides of, and a head arranged on, a respective one of a first number of imaginary straight lines extending across the complete heat transfer area parallel to a longitudinal centre axis of the plate. Each imaginary straight line comprises at least one primary portion along which at least three of the first arrow heads are (Continued)

arranged, uniformly spaced. A majority of the imaginary straight lines comprise at least one secondary portion each along which an extension of the ridges and valleys on one side of the imaginary straight line is parallel with the extension of the ridges and valleys on another opposite side of the imaginary straight line.

15 Claims, 6 Drawing Sheets

(56) References Cited

U.S. PATENT DOCUMENTS

| | | | | |
|---|---|---|---|---|
| 5,226,474 | A * | 7/1993 | Hallgren | B01D 1/221 165/110 |
| 6,702,005 | B1 | 3/2004 | Blomgren | |
| 2012/0325434 | A1 | 12/2012 | Blomgren et al. | |
| 2015/0247682 | A1* | 9/2015 | Nilsson | F28D 9/005 165/185 |
| 2015/0276319 | A1* | 10/2015 | Hedberg | F28F 3/046 165/166 |
| 2016/0282058 | A1* | 9/2016 | Blomgren | F28F 3/046 |

FOREIGN PATENT DOCUMENTS

| | | | |
|---|---|---|---|
| CN | 202793111 | U | 3/2013 |
| CN | 203443451 | U | 2/2014 |
| CN | 204188044 | U | 3/2015 |
| CN | 205279836 | U | 6/2016 |
| CN | 106197094 | A | 12/2016 |
| CN | 206001956 | U | 3/2017 |
| DE | 2944799 | A1 | 5/1980 |
| EP | 0463298 | A1 | 1/1992 |
| EP | 2728292 | A1 | 5/2014 |
| EP | 2886997 | A1 | 6/2015 |
| EP | 1 963 771 | B1 | 7/2019 |
| GB | 1468514 | A | 3/1977 |
| JP | 2011-523025 | A | 8/2011 |
| JP | 2012122687 | A | 6/2012 |
| RU | 2 413 916 | C2 | 3/2011 |
| TW | I509210 | B | 11/2015 |
| WO | 94/19657 | A1 | 9/1994 |
| WO | 9419657 | A1 | 9/1994 |
| WO | 2009/151399 | A1 | 12/2009 |
| WO | 2009154543 | A1 | 12/2009 |
| WO | 2011133087 | A2 | 10/2011 |
| WO | 2014067757 | A1 | 5/2014 |
| WO | 2014067758 | A1 | 5/2014 |
| WO | 2015/193057 | A1 | 12/2015 |

OTHER PUBLICATIONS

Written Opinion (PCT/ISA/237) dated Mar. 27, 2018, by the European Patent Office as the International Searching Authority for International Application No. PCT/EP2017/082766.

Office Action (The First Office Action) dated Jul. 31, 2020, by the State Intellectual Property Office of People's Republic of China in corresponding Chinese Patent Application No. 201780090072.1 and an English Translation of the Office Action. (11 pages).

An English Translation of the Office Action (Decision to Grant) dated Mar. 26, 2020, by the Federal Service for Intellectual Property (Rospatent) in corresponding Russian Patent Application No. 2019137945/06(074763). (5 pages).

Notice of Allowance (Decision to Grant a Patent) dated Dec. 14, 2020, by the Japanese Patent Office in corresponding Japanese Patent Application No. 2019-558469 and an English Translation of the Notice of Allowance. (5 pages).

* cited by examiner

HEAT TRANSFER PLATE AND HEAT EXCHANGER COMPRISING A PLURALITY OF SUCH HEAT TRANSFER PLATES

TECHNICAL FIELD

The invention relates to a heat transfer plate and its design. The invention also relates to a plate heat exchanger comprising a plurality of such heat transfer plates.

BACKGROUND ART

Plate heat exchangers, PHEs, typically consist of two end plates in between which a number of heat transfer plates are arranged in an aligned manner, i.e. in a stack or pack. Parallel flow channels are formed between the heat transfer plates, one channel between each pair of adjacent heat transfer plates. Two fluids of initially different temperatures can flow alternately through every second channel for transferring heat from one fluid to the other, which fluids enter and exit the channels through inlet and outlet port holes in the heat transfer plates.

Typically, a heat transfer plate comprises two end areas and an intermediate heat transfer area. The end areas comprise the inlet and outlet port holes and a distribution area pressed with a distribution pattern of projections and depressions, such as ridges and valleys, in relation to a central extension plane of the heat transfer plate. Similarly, the heat transfer area is pressed with a heat transfer pattern of projections and depressions, such as ridges and valleys, in relation to said central extension plane. In a plate heat exchanger, the ridges and valleys of the distribution and heat transfer patterns of one heat transfer plate may be arranged to contact, in contact areas, ridges and valleys of distribution and heat transfer patterns of adjacent heat transfer plates.

The main task of the distribution area of the heat transfer plates is to spread a fluid entering the channel across a width of the heat transfer plate before the fluid reaches the heat transfer area, and to collect the fluid and guide it out of the channel after it has passed the heat transfer area. On the contrary, the main task of the heat transfer area is heat transfer. Since the distribution area and the heat transfer area have different main tasks, the distribution pattern normally differs from the heat transfer pattern. The distribution pattern may be such that it offers a relatively weak flow resistance and low pressure drop which is typically associated with a more "open" pattern design, such as a so-called chocolate pattern, offering relatively few, but large, contact areas between adjacent heat transfer plates. The heat transfer pattern may be such that it offers a relatively strong flow resistance and high pressure drop which is typically associated with a more "dense" pattern design offering more, but smaller, contact areas between adjacent heat transfer plates.

One well-known heat transfer pattern is the so-called herringbone or chevron pattern which comprises ridges and valleys forming arrows with heads arranged in rows extending across the heat transfer area parallel to a longitudinal centre axis of the heat transfer plate, which longitudinal centre axis extends through both end areas of the heat transfer plate. FIG. 1*a*, which originates from GB 1468514, illustrates such a herringbone type heat transfer pattern. This pattern may give a heat transfer plate a good heat transfer capacity but it may also make the heat transfer plate dimensionally unstable and difficult to handle, especially if the heat transfer plate is large. U.S. Pat. No. 6,702,005 presents a solution to this problem. FIG. 1*b* originates from U.S. Pat. No. 6,702,005 and illustrates a heat transfer plate provided with a heat transfer pattern comprising arrows with heads arranged in rows, illustrated by dashed lines, extending across the heat transfer area parallel to a longitudinal centre axis I of the heat transfer plate. The arrows having heads arranged in one and the same row point in opposite directions within different portions of the row, i.e. the heat transfer pattern is varied along the longitudinal centre axis I of the heat transfer plate. Thereby, the heat transfer plate becomes dimensionally more stable, or stiffer, and thus easier to handle. However, where the heat transfer pattern changes and the arrows point towards each other, i.e. within encircled areas a of the heat transfer area, stress concentrations may be formed which may result in the formation of cracks in the heat transfer plate. Further, as regards the heat transfer plate according to FIG. 1*a* just like the heat transfer plate according to FIG. 1*b*, the rows of arrow heads may cause enclosure of the fluids flowing through the channels of the PHE and obstruct distribution of the fluids across the heat transfer area, which could affect the heat transfer capacity of the PHE.

SUMMARY

An object of the present invention is to provide a heat transfer plate which solves, or at least greatly reduces, the above mentioned problems. The basic concept of the invention is to provide the heat transfer plate with a heat transfer area having a corrugation pattern defining discontinuous rows of arrow heads across the heat transfer area, i.e. a more open corrugation pattern. Another object of the present invention is to provide a heat exchanger comprising a plurality of such heat transfer plates. The heat transfer plate and the heat exchanger for achieving the objects above are defined in the appended claims and discussed below.

A heat transfer plate according to the present invention includes a heat transfer area. The heat transfer area is provided with a corrugation pattern comprising alternately arranged ridges and valleys in relation to a central extension plane of the heat transfer plate. The ridges form arrows comprising first arrows. The first arrows are the arrows which each comprises two legs arranged on opposite sides of, and a head arranged on, a respective one of a first number of imaginary straight lines extending across the complete heat transfer area parallel to a longitudinal centre axis of the heat transfer plate. Each of the imaginary straight lines comprises at least one primary portion along which at least three of the first arrows heads are arranged, uniformly spaced. The heat transfer plate is characterized in that at least a majority of the imaginary straight lines comprise at least one secondary portion each along which an extension of the ridges and valleys on one side of the imaginary straight line is parallel with the extension of the ridges and valleys on another opposite side of the imaginary straight line. Further, the heat transfer area is divided into a second number of transverse bands extending transverse to the longitudinal centre axis of the heat transfer plate and from a first to an opposing second long side of the heat transfer area. Within the outermost transverse bands the corrugation pattern is similar.

Thus, the corrugation pattern within the heat transfer area is at least partly of herring bone or chevron type. The ridges and valleys extend parallel to each other, why not only the ridges, but also the valleys, form arrows. The arrows comprises first arrows defined as above. The arrows may also comprise second arrows which each may comprise two legs arranged on opposite sides of, and a head arranged on, a respective one of a third number of imaginary straight lines extending across the complete heat transfer area parallel to a transverse centre axis of the heat transfer plate.

Thus, each end point of each of the primary portions of the imaginary straight lines is defined by, i.e. coincides with, the head of one of the first arrows, and at least one further first arrow head is arranged between the end points of each of the primary portions. Further, a distance between two adjacent ones of the first arrow heads is uniform along each of the primary portions, but may vary between primary portions.

Along the complete secondary portions of the imaginary straight lines, the extension of the ridges and valleys on opposite sides of, and immediately adjacent to, the imaginary straight lines is parallel. Along each of the secondary portions, at least three uniformly spaced ridges may be arranged on each side of the corresponding imaginary straight line. The distance between adjacent ridges on one side of the imaginary straight line may or may not be equal to the distance between adjacent ridges on the other side of the imaginary straight line.

The primary and secondary portions of each imaginary straight line are non-overlapping. Further, two primary portions of an imaginary straight line are never successively arranged, which is true also for two secondary portions of an imaginary straight line.

A first arrow can be formed by an angled or bent ridge, the bend defining the head of the first arrow. Alternatively, a first arrow can be formed by two ridges angled in relation to each other, end point to end point, the end points defining the head of the first arrow. The end points may contact each other, or be slightly separated from each other along the transverse centre axis, and/or be slightly displaced in relation to each other along the longitudinal centre axis.

Along the secondary portions of the imaginary straight lines, the ridges and valleys on one side of the imaginary straight line may be integral with, or separate from, the ridges and valleys on the other opposite side of the imaginary straight line.

Naturally, the central extension plane is imaginary.

By ridge is meant an elongate continuous elevation, straight or curved, that may extend, with reference to the longitudinal centre axis of the heat transfer plate, obliquely across the complete, or a portion of the, heat transfer area. Similarly, by valley is meant an elongate continuous trench, straight or curved, that may extend, with reference to the longitudinal centre axis of the heat transfer plate, obliquely across the complete, or a portion of the, heat transfer area.

Naturally, the first number of imaginary straight lines determines how much "at least a majority" is. The first number of imaginary straight lines may be three or more. In the case of three imaginary straight lines, "at least a majority" is two or three. In the case of five imaginary straight lines, "at least a majority" is three, four or five.

The second number of transverse bands is ≥2 and more preferred ≥3.

As said above, the corrugation pattern within one of the outermost transverse bands of the heat transfer area is similar to the corrugation pattern within the other one of the outermost transverse bands. Here, "similar" should not be interpreted as necessarily meaning fully, but at least essentially, identical. Further, here, "similar" means that the corrugation pattern has the same orientation in the outermost transverse bands, i.e. that if the corrugation pattern within one of the outermost transverse bands could be displaced along the longitudinal centre axis of the heat transfer plate, it could coincide with the corrugation pattern within the other one of the outermost transverse bands. It should be stressed that even if the corrugation pattern is similar within the outermost transverse bands, the corrugation pattern within one of the outermost transverse bands may be displaced in relation to the corrugation pattern within the other one of the outermost transverse bands. In other words, a location of the corrugation pattern within one of the outermost transverse bands, in relation to borders of said one of the outermost transverse bands, may differ from a location of the corrugation pattern within the other one of the outermost transverse bands, in relation to borders of said other one of the outermost transverse bands. The pattern similarity between the outermost transverse bands is beneficial when it comes to stacking of a plurality of heat transfer plates in a plate heat exchanger. This often involves rotation of every second one of the heat transfer plates 180 degrees about an axis extending parallel to a normal direction of the heat transfer plate, in relation to a reference plate orientation. The pattern similarity may then enable pattern crossing resulting in a sufficient density, and a suitable distribution, of contact points between two adjacent heat transfer plates.

Thus, the first arrow heads are arranged in rows extending across the heat transfer area parallel to the longitudinal centre axis of the heat transfer plate. These rows coincide with the imaginary straight lines. Since at least a majority of the imaginary straight lines comprise at least one secondary portion each, at least a majority of the rows of first arrow heads are discontinuous. Accordingly, the present invention renders it possible to vary the corrugation pattern within the heat transfer area along the longitudinal centre axis of the heat transfer plate, so as to make the heat transfer plate dimensionally stable and easy to handle. Further, the corrugation pattern may be varied without creating, or with the creation of only a few (as compared to U.S. Pat. No. 6,702,005), areas where the heat transfer pattern changes and the first arrows point towards each other. Thereby, stress concentrations in the heat transfer plate, along the imaginary straight lines, may be reduced, which results in a decreased risk of crack formation. Further, the discontinuous rows of first arrow heads make the corrugation pattern more open such that a fluid flowing across the heat transfer area more easily can cross the imaginary straight lines for a more even flow distribution across the heat transfer plate.

The heat transfer plate may further comprise two end areas between which the heat transfer area is arranged. Each of the end areas may comprise two port hole areas, which may be open, i.e. port holes, or closed, and a distribution area arranged between the heat transfer area and the port hole areas and provided with a corrugation pattern which differs from the corrugation pattern of the heat transfer area. The longitudinal center axis of the heat transfer plate extends through the end areas and the heat transfer area.

The heat transfer plate may be such that, along said secondary portions of said at least a majority of the imaginary straight lines, the extension of the ridges and valleys on said one side of the imaginary straight line is aligned with the extension of the ridges and valleys on said opposite side of the imaginary straight line. This renders it possible to have the same corrugation pattern on both sides of, and/or ridges and valleys crossing, with unaltered direction, the imaginary straight line, which may result in a stiffer heat transfer plate which is easier to handle.

The heat transfer plate may be such that each of the imaginary straight lines, except for a first one of the imaginary straight lines, comprises at least one secondary portion. This means that all rows of first arrow heads but one is discontinuous, which enables a heat transfer plate that is particularly stable and easy to handle and that has an even more open corrugation pattern for an even more uniform flow distribution across the heat transfer plate.

The first imaginary straight line may coincide with the longitudinal centre axis of the heat transfer plate. This enables heat transfer area with a corrugation pattern that is symmetric with respect to the longitudinal center axis.

The heat transfer plate may be so designed that at least one of the imaginary straight lines on each side of the first imaginary straight line comprises at least two primary portions, and at least another one of the imaginary straight lines on each side of the first imaginary straight line comprises at least two secondary portions, which may result in a dimensionally more stable heat transfer plate which is easier to handle.

As mentioned above, the heat transfer area is divided into a second number of transverse bands. The corrugation pattern within each of the transverse bands may be varying from the corrugation pattern within an adjacent one of the transverse bands. Also, the corrugation pattern within a transverse band arranged between two other transverse bands may differ from the corrugation pattern within each of the two other transverse bands. Further, irrespective of whether the corrugation pattern within adjacent transverse bands differs or not, each of the primary and secondary portions of the imaginary straight lines may extend completely across a respective one of the transverse bands.

Each two adjacent ones of the transverse bands may be separated by a respective groove extending in the central extension plane of the heat transfer plate from the first to the second long side of the heat transfer area. Thereby, variation of the corrugation pattern across the heat transfer are may be facilitated. As above discussed, such variation may make the heat transfer plate dimensionally more stable, or stiffer, and easier to handle.

The outermost transverse bands, which define two opposing first and second short sides of the heat transfer area, may have similar outlines or contours or borders. Here, "similar" should not be interpreted as necessarily meaning fully, but at least essentially, identical. This is beneficial when it comes to stacking of a plurality of heat transfer plates in a plate heat exchanger, which often involves rotation of every second one of the heat transfer plates 180 degrees about an axis extending parallel to a normal direction of the heat transfer plate, in relation to a reference plate orientation. The outline similarity may then enable a sufficient density, and a suitable distribution, of contact points between two adjacent heat transfer plates.

Each of the transverse bands may be delimited by a first and a second borderline, at least one of which is curved. This means that a border between two adjacent transverse bands, or one of the outer transverse bands and one of the end areas, may be curved. Thereby, a bending strength of the heat transfer plate may be increased at the border as compared to if the border instead was straight, in which case the border could serve as a bending line of the heat transfer plate.

Each of the outermost transverse bands may have a varying width as measured parallel to the longitudinal center axis of the heat transfer plate. The width may be decreasing in a direction from the first long side of the heat transfer area towards the longitudinal center axis of the heat transfer plate, and in a direction from the second long side of the heat transfer area towards the longitudinal axis of the heat transfer plate. This embodiment may render it possible for the end areas of the heat transfer plate to have a borderline facing the heat transfer area which is bulging outward towards a center of the heat transfer plate. As will be further discussed below, such end areas may involve an increased distribution efficiency.

One of the transverse bands arranged between the outermost transverse bands may have a varying width as measured parallel to the longitudinal center axis of the heat transfer plate. The width may be increasing in a direction from the first long side of the heat transfer area towards the longitudinal center axis of the heat transfer plate, and in a direction from the second long side of the heat transfer area towards the longitudinal axis of the heat transfer plate. Thereby, this intermediate transverse band may fit together with the outermost transverse bands which may render it possible to have the transverse bands occupying the entire heat transfer area. This is beneficial as regards a heat transfer capacity of the heat transfer plate.

The corrugation pattern of the heat transfer area may be symmetric with respect to the longitudinal center axis of the heat transfer plate. This is beneficial when it comes to stacking of a plurality of heat transfer plates in a plate heat exchanger, which often involves rotation of every second one of the heat transfer plates 180 degrees about an axis extending parallel to a normal direction of the heat transfer plate, in relation to a reference plate orientation. This symmetry may then enable a sufficient density, and a suitable distribution, of contact points between two adjacent heat transfer plates.

The first arrows arranged along the same one of the imaginary straight lines may point in the same direction. This embodiment may enable a heat transfer area comprising a corrugation pattern completely lacking areas where the heat transfer pattern changes and the first arrows point towards each other. In turn, this enables a particularly crack resistant heat transfer plate.

The ridges and valleys may, on an outside of an outermost one of the imaginary straight lines, all extend with a smallest angle of 0-90 degrees in relation to said outermost imaginary straight line, as measured from said outermost imaginary straight line in a first direction. This first direction is either a clockwise or a counter-clockwise direction. Thereby, a relatively uniform edge displacement resulting from pressing of the heat transfer plate, and thus a relatively even heat transfer plate edge, may be achieved, which is beneficial as regards the strength of the heat transfer plate. Naturally, the above feature may exist on an outside of both outermost imaginary straight lines.

A heat exchanger according to the present invention comprises a plurality of heat transfer plates as described above.

Still other objectives, features, aspects and advantages of the invention will appear from the following detailed description as well as from the drawings.

BRIEF DESCRIPTION OF THE DRAWINGS

The invention will now be described in more detail with reference to the appended schematic drawings, in which.

DETAILED DESCRIPTION

Figure 2:
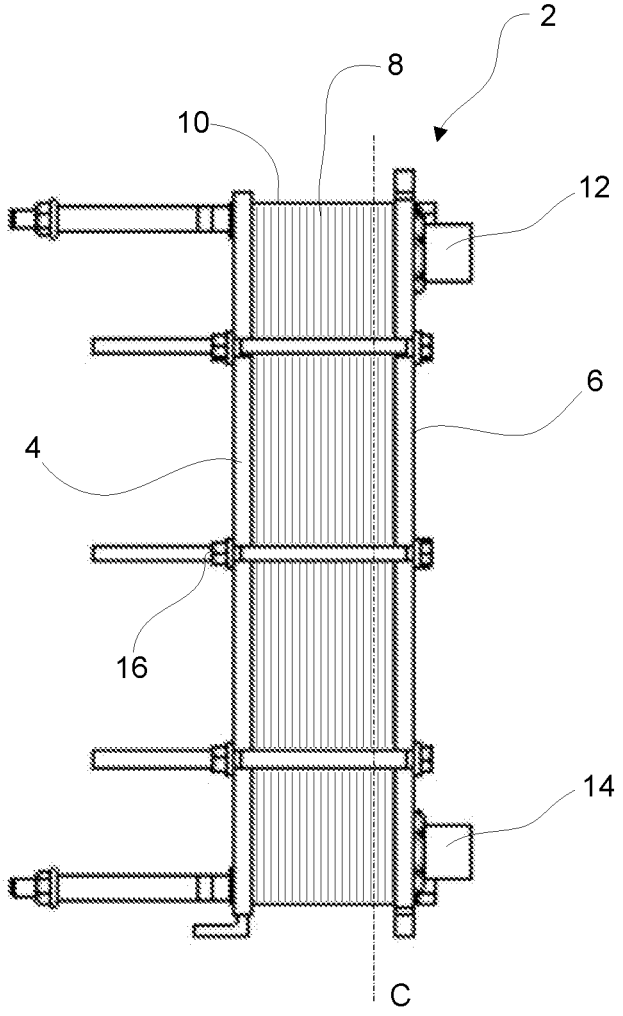
FIG. 2 is a side view of a plate heat exchanger according to the invention.

With reference to FIG. 2, a gasketed plate heat exchanger 2 is shown. It comprises a first end plate 4, a second end plate 6 and a number of heat transfer plates 8 arranged in a plate pack 10 between the first and second end plates 4 and 6, respectively. The heat transfer plates are all of the type illustrated in FIG. 3.

The heat transfer plates 8 are separated from each other by gaskets (not shown). The heat transfer plates together with the gaskets form parallel channels arranged to alternately receive two fluids for transferring heat from one fluid to the other. To this end, a first fluid is arranged to flow in every second channel and a second fluid is arranged to flow in the remaining channels. The first fluid enters and exits the plate heat exchanger 2 through an inlet 12 and an outlet 14, respectively. Similarly, the second fluid enters and exits the plate heat exchanger 2 through an inlet and an outlet (not visible in the figures), respectively. For the channels to be leak proof, the heat transfer plates must be pressed against each other whereby the gaskets seal between the heat transfer plates 8. To this end, the plate heat exchanger 2 comprises a number of tightening means 16 arranged to press the first and second end plates 4 and 6, respectively, towards each other.

The design and function of gasketed plate heat exchangers are well-known and will not be described in detail herein.

One of the heat transfer plates 8 will now be further described with reference to FIGS. 3 and 7 which illustrate the heat transfer plate and a cross section of the heat transfer plate, respectively. The heat transfer plate 8 is an essentially rectangular sheet of stainless steel pressed, in a conventional manner, in a pressing tool, to be given a desired structure. It defines a top plane T, a bottom plane B and a central extension plane C (see also FIG. 2) which are parallel to each other and to the figure plane of FIG. 3. The central extension plane C extends half way between the top and bottom planes, T and B, respectively. The heat transfer plate further has a longitudinal centre axis I and a transverse centre axis t.

The heat transfer plate 8 comprises a first end area 18, a second end area 20 and a heat transfer area 22 arranged there between. In turn, the first end area 18 comprises an open inlet port hole area, i.e. an inlet port hole, 24 for the first fluid and an open outlet port hole area, i.e. an outlet porthole, 26 for the second fluid arranged for communication with the inlet 12 for the first fluid and the outlet for the second fluid, respectively, of the plate heat exchanger 2. Further, the first end area 18 comprises a first distribution area 28 provided with a distribution pattern in the form of a so-called chocolate pattern (not illustrated in FIG. 3 but in FIG. 6). Similarly, in turn, the second end area 20 comprises an open outlet port hole area, i.e. an outlet port hole, 30 for the first fluid and an open inlet port hole area, i.e. an inlet port hole, 32 for the second fluid arranged for communication with the outlet 14 of the first fluid and the inlet of the second fluid, respectively, of the plate heat exchanger 2. Further, the second end area 20 comprises a second distribution area 34 provided with a distribution pattern in the form of a so-called chocolate pattern (not illustrated in FIG. 3 but in FIG. 6). The structures of the first and second end areas are the same but mirror inverted with respect to the transverse centre axis t.

The heat transfer area 22 is provided with a corrugation pattern of herringbone type which is symmetric with respect to the longitudinal center axis I of the heat transfer plate. It comprises alternately arranged ridges 36 and valleys 38 in relation to the central extension plane C which defines the border between the ridges and valleys. This is clear form FIG. 7, which, however, illustrate just one complete ridge and two valleys. In FIG. 3, the zig-zag lines illustrate the ridges while the space between the zig-zag lines illustrate the valleys. Naturally, the ridges and valleys as seen from one side of the heat transfer plate are valleys and ridges, respectively, as seen from the other side of the heat transfer plate.

The heat transfer area 22 is divided into three transverse bands, two outermost transverse bands 40 and 42 and one intermediate transverse band 44 arranged between the outermost transverse bands. Each of the transverse bands extends transverse to the longitudinal centre axis I of the heat transfer plate 8 and from a first long side 46 to a second long side 48 of the heat transfer area 22. The outermost transverse bands 40 and 42 are essentially similar and the corrugation pattern within them is thus similar. However, the corrugation pattern within the outermost transverse band 40 is displaced in relation to the corrugation pattern within the outermost transverse band 42 such that the positions of the valleys in the outermost band 40 corresponds to the positions of the ridges in the outermost band 42. The corrugation pattern within the intermediate transverse band 44 is different from the corrugation pattern within the outermost bands 40 and 42. It should be stressed that only some of the ridges and valleys of the corrugation pattern are illustrated in FIG. 3 (and in FIGS. 4 and 5). In reality, as is illustrated in FIG. 6, the corrugation pattern covers the complete heat transfer area 22. Thereby, some of the ridges and valleys will be zig-zag shaped, some will be V shaped and some will be straight.

Each of the transverse bands is limited by a first and second borderline which for the outermost transverse band 40 are denoted 50 and 52, respectively. The first and second borderlines of the intermediate transverse band 44 coincide with the second borderline 52 of the outermost transverse band 40, and the first borderline of the outermost transverse band 42, respectively. The coinciding borderlines of the transverse bands coincide with grooves 54 and 56 extending in the central extension plane C of the heat transfer plate from the first long side 46 to the second long side 48 of the heat transfer area 22.

Figure 3:
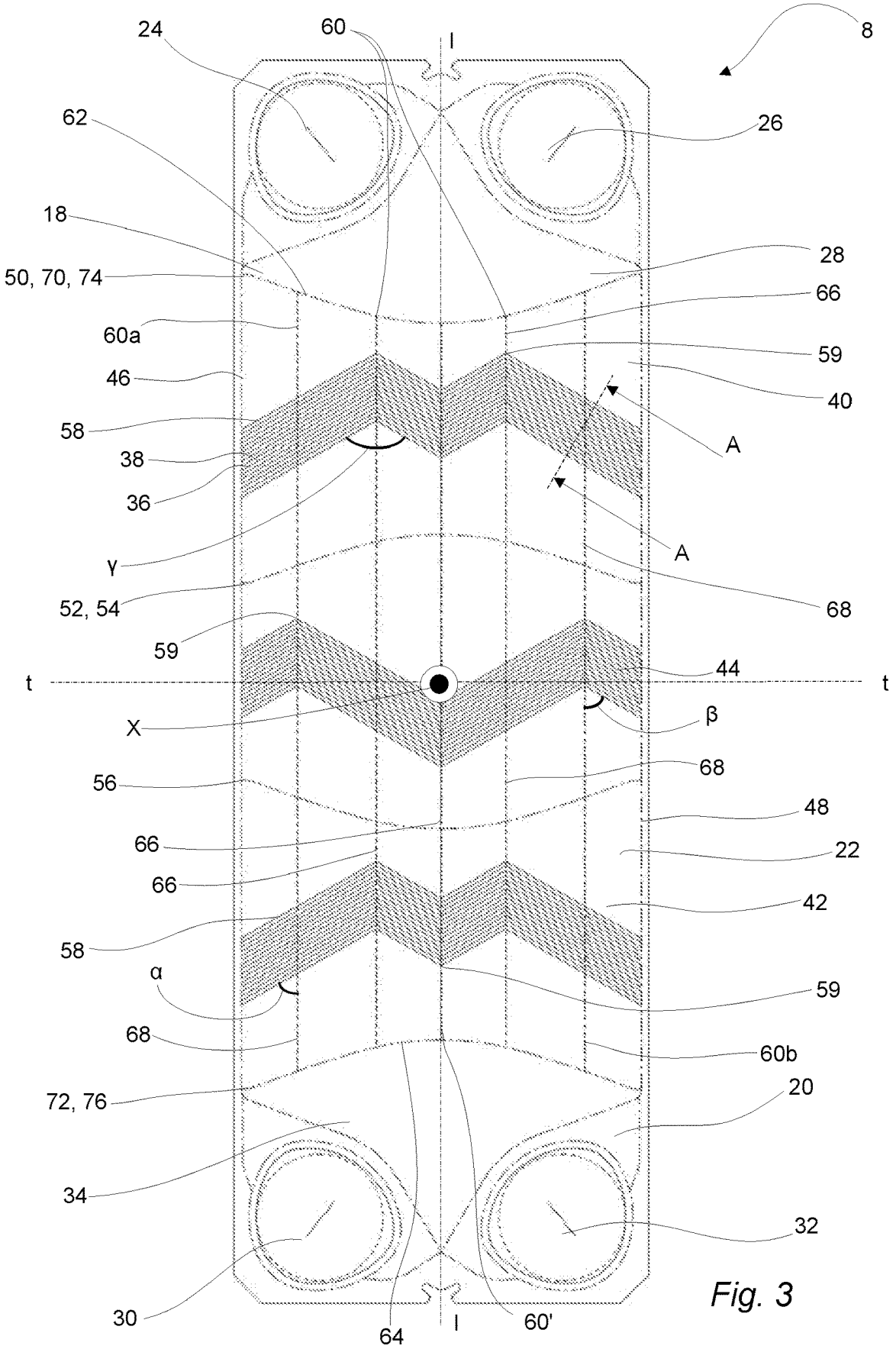
FIG. 3-6 are schematic plan views of a heat transfer plate according to four different embodiments of the invention, and FIG. 7 schematically illustrates a part of a cross section of the heat transfer plate of FIG. 3, taken along line A-A.

As is clear from FIG. 3, the first and second borderlines 50 and 52 of the outermost transverse band 40, and thus also the outermost transverse band 42, are curved and inwards bulging or concave as seen from within the respective outermost transverse band. This gives the outermost transverse bands 40 and 42 a varying width, the width being measured parallel to the longitudinal centre axis I, more particularly a width decreasing from the first and second long sides 46 and 48 of the heat transfer area 22 towards the longitudinal centre axis I of the heat transfer plate 8. Further, the first and second borderlines of the intermediate transverse band 44 are curved and outwards bulging or convex as seen from within the intermediate transverse band. This gives the intermediate transverse band 44 a varying width, more particularly a width increasing from the first and second long sides 46 and 48 towards the longitudinal centre axis I.

The zig-zag and V shaped ridges within the transverse bands form first arrows 58 with respective heads 59. Since the valleys extend between, and parallel to, the ridges, these also form arrows with respective heads. The first arrows heads within each of the transverse bands are arranged in sequences extending from the first to the second borderlines of the transverse bands, with first arrow heads 59 arranged along the complete sequences with a uniform distance between adjacent first arrow heads. The sequences form continuous or discontinuous rows which coincide with imaginary straight lines 60, here five, extending across the complete heat transfer area, from a first short side 62 to a second short side 64, thereof. The imaginary straight lines 60 extend parallel to the longitudinal centre axis I of the heat transfer plate 8 on a distance from each other.

The first arrows 58 along the same one of the imaginary straight lines all point in the same direction. Further, as is clear from FIG. 3, all first arrows have the same angle γ. Therefore, all the ridges 36 and the valleys 38 extend in parallel on an outside of outermost imaginary straight lines 60*a* and 60*b*. More particularly, on the outside of the outermost imaginary straight line 60*a*, the ridges 36 and the valleys 38 all extend with the same smallest angle $\alpha=\gamma/2=60$ degrees in relation to the outermost imaginary straight line 60*a* as measured from the outermost imaginary straight line 60*a* in a clockwise direction. Similarly, on the outside of the outermost imaginary straight line 60*b*, the ridges 36 and the valleys 38 all extend with the same smallest angle $\beta=\gamma/2=60$ degrees in relation to the outermost imaginary straight line 60*b* as measured from the outermost imaginary straight line 60*b* in a counter-clockwise direction.

The portions of the imaginary straight lines 60 occupied by the sequences of first arrow heads 59, i.e. along which a plurality of first arrows are arranged uniformly spaced, are herein referred to as primary portions 66. As is clear from FIG. 3, there are three primary portions 66 within each of the transverse bands 40, 42 and 44 of the heat transfer area 22. Further, each of the imaginary straight lines 60 comprises one, two or three primary portions 66. The portions of the imaginary straight lines 60 outside the primary portions are herein referred to as secondary portions 68. Along the secondary portions 68, the ridges 36 and valleys 38 cross the imaginary straight lines 60 unbent, i.e. with unaltered direction, such that an extension of the ridges and valleys immediately on one side of the imaginary straight line is aligned with an extension of the ridges and valleys immediately on an opposite side of the imaginary straight line. As is clear form FIG. 3, there are two secondary portions 68 within each of the transverse bands 40, 42 and 44 of the heat transfer area 22. Further, all imaginary straight lines 60 except for a first centred one 60' coinciding with the longitudinal centre axis I, comprise one or two secondary portions 68. The first imaginary straight line 60' lacks a secondary portion.

Thus, as is clear from FIG. 3, the outermost imaginary straight lines 60*a* and 60*b* each comprises one primary and two secondary portions, while the intermediate imaginary straight lines arranged between the first centred and each of the outermost imaginary straight lines each comprises one secondary and two primary portions.

As described above, the borderlines of the transverse bands 40, 42 and 44 of the heat transfer area 22 are curved. Further, as is clear from FIG. 3, also a respective first borderline 70 and 72 of the end areas 18 and 20 is curved and outwards bulging or convex as seen from within the respective end areas. The first borderlines 70 and 72 of the end areas 18 and 20, respectively, coincides with the first borderline 50 of the outermost transverse band 40, and the second borderline of the outermost transverse band 42, respectively, and with grooves 74 and 76, respectively. The grooves extend in the central extension plane C of the heat transfer plate 8 and from the first long side 46 to the second long side 48 of the heat transfer area 22.

The borderlines of the transverse bands and the end areas are all uniform. Thereby, pressing of the heat transfer plate with a modular tool, which is used to manufacture heat transfer plates of different sizes containing different numbers of transverse bands by addition/removal of transverse bands adjacent to the end areas, is enabled.

In that the first borderlines 70 and 72 are outwards bulging, they are longer than corresponding straight first borderlines would be. This results in larger "outlets" of the end areas which is beneficial as regards the fluid distribution across a width of the heat transfer area.

The heat transfer plates 8 of the plate heat exchanger 2 are stacked between the first and second end plates 4 and 6 with a front side (visible in FIG. 3) and a back side of one heat transfer plate facing a back side and a front side, respectively, of adjacent heat transfer plates. Further, every second heat transfer plate is rotated 180 degrees, in relation to a reference orientation, about a centre axis (X) of the heat transfer plates extending through a centre, and perpendicularly to the central extension plane (C), of the heat transfer plates. Thereby, the ridges and valleys of said one heat transfer plate will cross and contact, in points, the valleys and ridges, respectively, of said adjacent heat transfer plates. Since the heat transfer plates do not comprise only continuous rows of equally spaced first arrows extending across the complete heat transfer area parallel to the longitudinal centre axis of the heat transfer plates, the channel formed between two adjacent ones of the heat transfer plates will be relatively open so as to allow an effective fluid spreading across the heat transfer areas of the heat transfer plates. Further, due to the lack of areas comprising a pattern change with first arrows pointing towards each other, the heat transfer plates will be resistant to crack formation.

Figure 4:
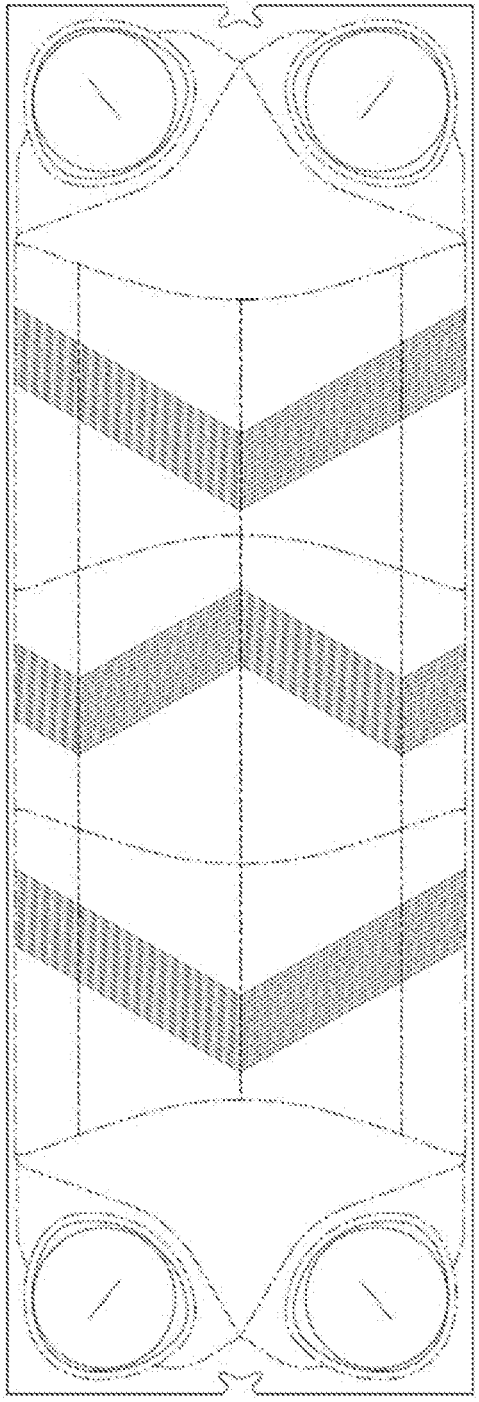
Figure 5:
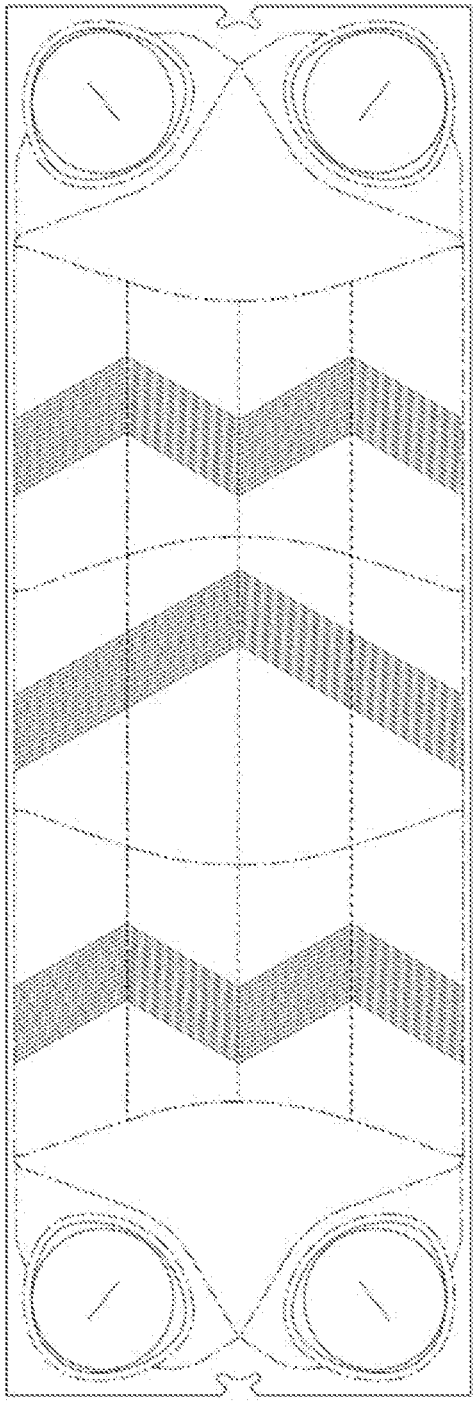
Figure 6:
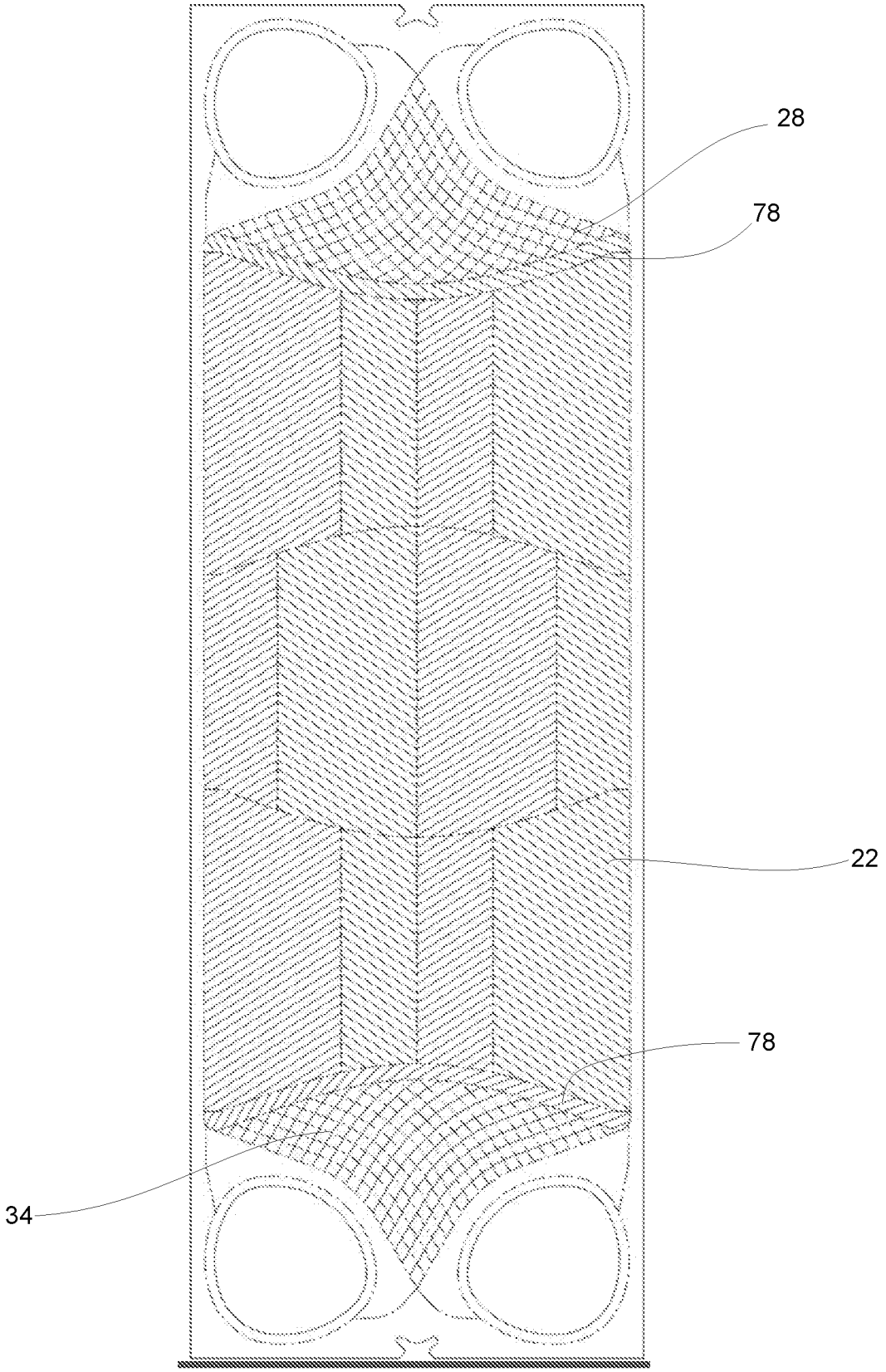

FIGS. 4 and 5 illustrate examples of other possible designs of a heat transfer plate according to the invention. Obviously, most of the above description is valid also for the heat transfer plates of FIGS. 4 and 5. However, there are three imaginary straight lines for the heat transfer plates according to FIGS. 4 and 5 instead of five. Two of the three imaginary straight lines for the heat transfer plate according to FIG. 4 comprise two secondary portions each, while two of the three imaginary straight lines for the heat transfer plate according to FIG. 5 comprise one secondary portion each. Further, along the first centred imaginary straight line for both the heat transfer plates, the first arrows within the intermediate transverse band and the first arrows within the outermost transverse bands point in opposite directions. Therefore, both the heat transfer plates comprises one area each, centred at the border between the upper (as seen in FIGS. 4 and 5) outermost and the intermediate transverse band, within which the corrugation pattern changes and the first arrows point towards each other.

FIG. 6 illustrates an example of another possible design of a heat transfer plate according to the invention. The heat transfer plate in FIG. 6 is essentially similar to the heat exchanger plate in FIG. 3 except for that a transition area 78 is arranged between each of the distribution areas 28 and 34 an the heat transfer area 22. The design, function and purpose of such transition areas are described in WO publication 2014/067757.

Naturally, many other heat transfer plate designs are possible within the scope of the present invention.

The above described embodiments of the present invention should only be seen as examples. A person skilled in the art realizes that the embodiments discussed can be varied and combined in a number of ways without deviating from the inventive conception.

As an example, the corrugation pattern within the distribution areas need not be a chocolate pattern but my be of other types.

Further, the heat transfer plate need not comprise three transverse bands and five or three imaginary straight lines, but may comprise another number of transverse bands and imaginary straight lines, and thus, other numbers and combinations, within the scope of the present invention, of primary and secondary portions. As an example, the heat transfer plate may comprise five transverse bands of which the outermost bands and the centre band are concave, and the bands between the centre band and each of the outermost bands are convex.

One or all of the borderlines of the transverse bands and the first borderlines of the end areas could be straight instead of curved. Accordingly, the transverse bands could have uniform widths.

The first arrows within the heat transfer area need not all have the same first arrow angle like above but may have a varying sharpness. Further, $\alpha$ and $\beta$ need not be equal, or equal to 60 degrees. Further, the imaginary straight lines could be uniformly distributed across the heat transfer area.

In the plate heat exchanger, the heat transfer plates need not be stacked as described above but could instead be stacked with a front side and a back side of one heat transfer plate facing a front side and a back side, respectively, of adjacent heat transfer plates, and with every second heat transfer plate rotated 180 degrees.

Figure 1A:
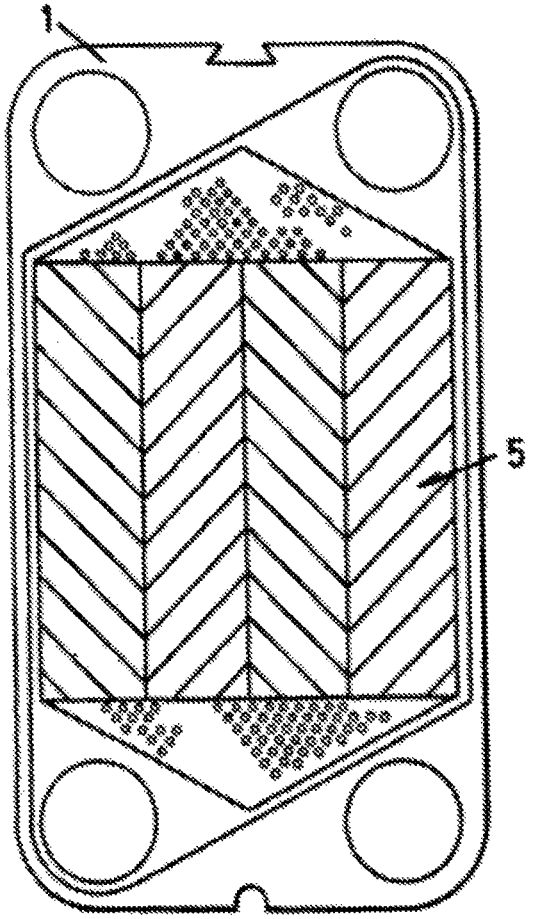
FIGS. 1*a*-1*b* are plan views of prior art heat transfer plates.
Figure 7:
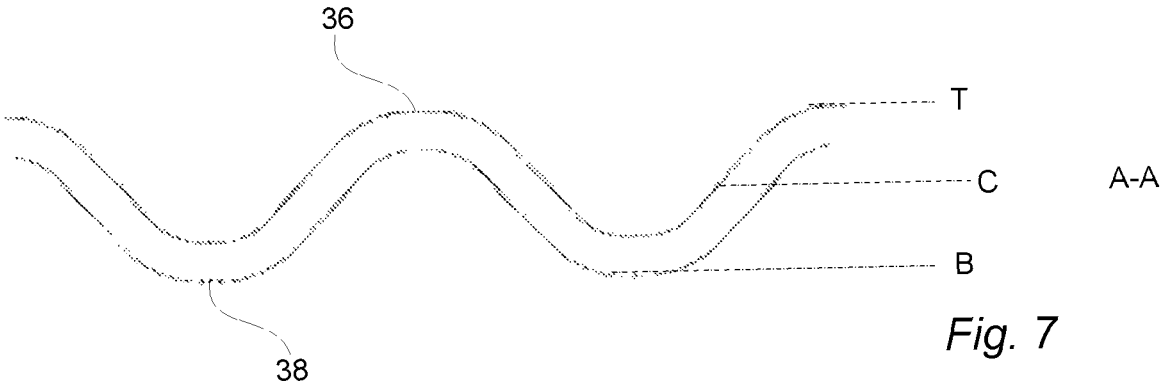
Figure 1B:
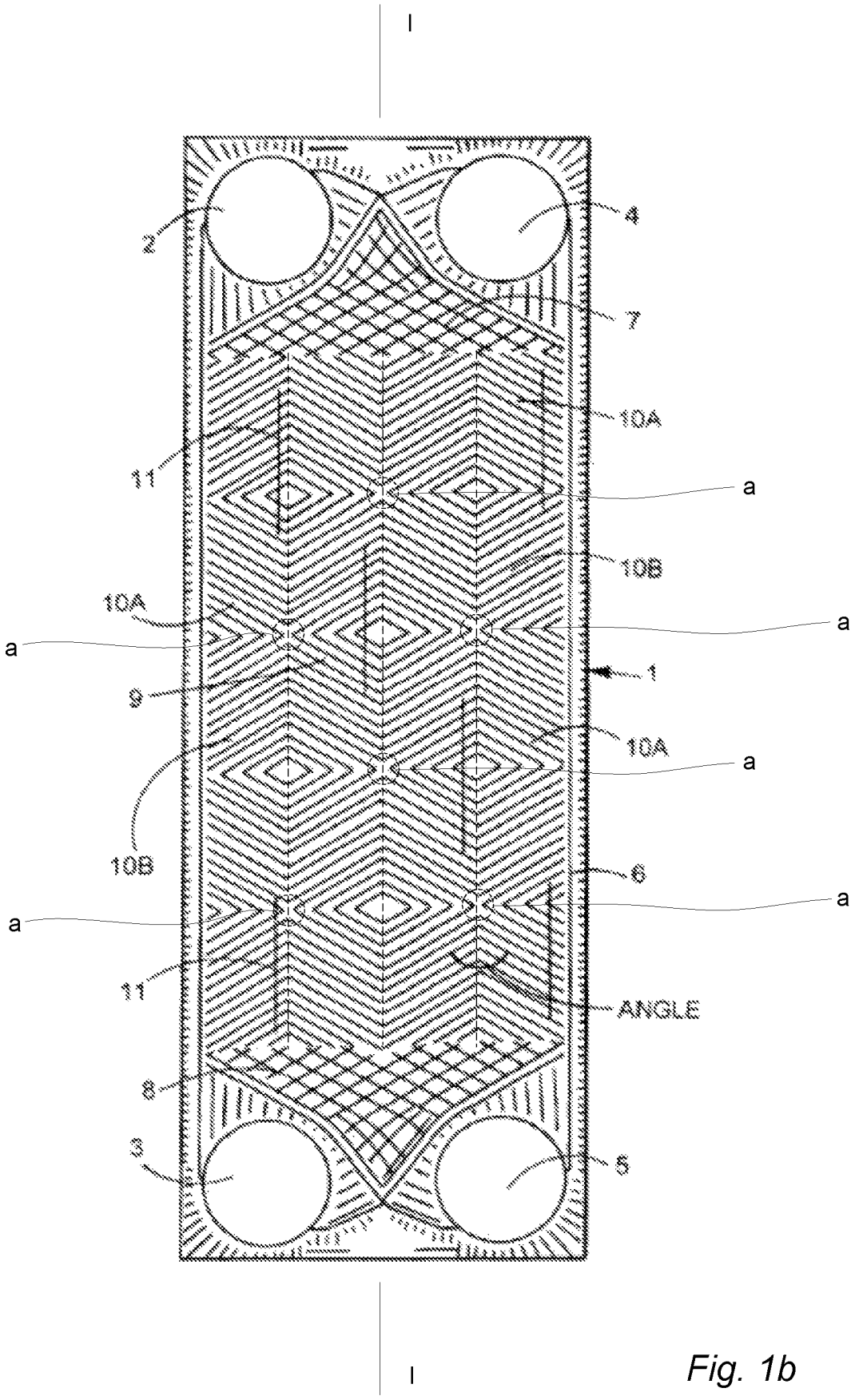

The ridges and valleys need not have a cross section as illustrated in FIG. 7 but can have any cross section, such as a cross section comprising one or more shoulders or flanks connecting the ridges and valleys.

The above described plate heat exchanger is of parallel counter flow type, i.e. the inlet and the outlet for each fluid are arranged on the same half of the plate heat exchanger and the fluids flow in opposite directions through the channels between the heat transfer plates. Naturally, the plate heat exchanger could instead be of diagonal flow type and/or a co-flow type.

The plate heat changer above comprises one plate type only. Naturally, the plate heat exchanger could instead comprise two or more different types of alternately arranged heat transfer plates. Further, the heat transfer plates could be made of other materials than stainless steel.

The present invention could be used in connection with other types of plate heat exchangers than gasketed ones, such as all-welded, semi-welded and brazed plate heat exchangers.

It should be stressed that a description of details not relevant to the present invention has been omitted and that the figures are just schematic and not drawn according to scale. It should also be said that some of the figures have been more simplified than others. Therefore, some components may be illustrated in one figure but left out on another figure.

The invention claimed is:

1. A heat transfer plate including a heat transfer area provided with a corrugation pattern comprising alternately arranged ridges and valleys in relation to a central extension plane of the heat transfer plate, which ridges form arrows comprising first arrows, which first arrows each comprises two legs arranged on opposite sides of, and a head arranged on, a respective one of a first number of imaginary straight lines extending across the complete heat transfer area parallel to a longitudinal centre axis of the heat transfer plate so that the head of every first arrow in the heat transfer area is arranged on a respective one of the imaginary straight lines, each of the imaginary straight lines comprising at least one primary portion along which at least three of the first arrow heads are arranged, uniformly spaced, wherein at least a majority of the imaginary straight lines comprise at least one secondary portion each along which an extension of the ridges and valleys on one side of the imaginary straight line is parallel with the extension of the ridges and valleys on another opposite side of the imaginary straight line, wherein the heat transfer area is divided into a second number of transverse bands extending transverse to the longitudinal centre axis of the heat transfer plate and from a first to an opposing second long side of the heat transfer area, wherein, within the outermost transverse bands, the corrugation pattern is the same.

2. A heat transfer plate according to claim 1, wherein, along said secondary portions of said at least a majority of the imaginary straight lines, the extension of the ridges and valleys on said one side of the imaginary straight line is aligned with the extension of the ridges and valleys on said opposite side of the imaginary straight line.

3. A heat transfer plate according to claim 1, wherein each of the imaginary straight lines, except for a first one of the imaginary straight lines, comprises at least one secondary portion.

4. A heat transfer plate according to claim 3, wherein said first imaginary straight line coincides with the longitudinal centre axis of the heat transfer plate.

5. A heat transfer plate according to claim 3, wherein at least one of the imaginary straight lines on each side of the first imaginary straight line comprises at least two primary portions, and at least another one of the imaginary straight lines on each side of the first imaginary straight line comprises at least two secondary portions.

6. A heat transfer plate according to claim 1, wherein the corrugation pattern within each of the transverse bands varying from the corrugation pattern within an adjacent one of the transverse bands, and each of the primary and secondary portions of the imaginary straight lines extending completely across a respective one of the transverse bands.

7. A heat transfer plate according to claim 1, wherein each two adjacent ones of the transverse bands is separated by a respective groove extending in the central extension plane of the heat transfer plate from the first to the second long side of the heat transfer area.

8. A heat transfer plate according to claim 1, wherein outlines of the outermost transverse bands are the same.

9. A heat transfer plate according to claim 1, wherein each of the transverse bands is delimited by a first and a second borderline, at least one of which is curved.

10. A heat transfer plate according to claim 1, wherein each of the outermost transverse bands has a varying width as measured parallel to the longitudinal center axis of the heat transfer plate, the width decreasing in a direction from the first long side of the heat transfer area towards the longitudinal center axis of the heat transfer plate, and in a direction from the second long side of the heat transfer area towards the longitudinal axis of the heat transfer plate.

11. A heat transfer plate according to claim 1, wherein one of the transverse bands arranged between the outermost transverse bands has a varying width as measured parallel to the longitudinal center axis of the heat transfer plate, the width increasing in a direction from the first long side of the heat transfer area towards the longitudinal center axis of the heat transfer plate, and in a direction from the second long side of the heat transfer area towards the longitudinal axis of the heat transfer plate.

12. A heat transfer plate according to claim 1, wherein the corrugation pattern of the heat transfer area is symmetric with respect to the longitudinal center axis of the heat transfer plate.

13. A heat transfer plate according to claim 1, wherein the arrows arranged along the same one of the imaginary straight lines point in the same direction.

14. A heat transfer plate according to claim 1, wherein the ridges and valleys, on an outside of an outermost one of the imaginary straight lines, all extend with a smallest angle ($\alpha$, $\beta$) of 0-90 degrees in relation to said outermost imaginary straight line, as measured from said outermost imaginary straight line in a first direction.

15. A heat exchanger comprising a plurality of heat transfer plates according to claim 1.

* * * * *